US008915175B2

(12) United States Patent
Xu

(10) Patent No.: US 8,915,175 B2
(45) Date of Patent: Dec. 23, 2014

(54) PNEUMATIC CYLINDER

(75) Inventor: Xiao-Bing Xu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 933 days.

(21) Appl. No.: 13/042,473

(22) Filed: Mar. 8, 2011

(65) Prior Publication Data

US 2012/0103181 A1 May 3, 2012

(30) Foreign Application Priority Data

Oct. 28, 2010 (CN) ..... 2010 1 0523203

(51) Int. Cl.
*F15B 15/14* (2006.01)
*A61G 3/06* (2006.01)

(52) U.S. Cl.
CPC ..... *F15B 15/1404* (2013.01)
USPC ..... 92/33; 269/37

(58) Field of Classification Search
USPC ..... 92/31, 33; 269/24, 27, 37
See application file for complete search history.

(56) References Cited

U.S. PATENT DOCUMENTS

| | | | | | |
|---|---|---|---|---|---|
| 3,605,569 | A * | 9/1971 | Sessody | 92/33 |
| 4,265,434 | A * | 5/1981 | Hamilton et al. | 92/33 |
| 5,192,058 | A * | 3/1993 | VanDalsem et al. | 269/24 |
| 6,474,214 | B2 * | 11/2002 | Takeuchi et al. | 92/33 |
| 7,111,834 | B2 * | 9/2006 | Steele et al. | 92/31 |
| 7,574,953 | B2 * | 8/2009 | Tanaka | 92/136 |
| 8,132,801 | B2 * | 3/2012 | Miyashita et al. | 269/24 |
| 2009/0096149 | A1 * | 4/2009 | Miyashita et al. | 269/49 |

FOREIGN PATENT DOCUMENTS

| | | | | |
|---|---|---|---|---|
| CN | 1149109 | A | 5/1997 | |
| CN | 1158287 | A | 9/1997 | |
| CN | 1290820 | A | 4/2001 | |
| CN | 2637794 | Y | 9/2004 | |
| CN | 201027722 | Y | 2/2008 | |
| CN | 201377477 | Y | 1/2010 | |
| DE | 10141752 | C1 * | 3/2003 | F15B 15/20 |
| GB | 2370319 | A | 6/2002 | |

* cited by examiner

*Primary Examiner* — Thomas E Lazo
(74) *Attorney, Agent, or Firm* — Novak Druce Connolly Bove + Quigg LLP

(57) ABSTRACT

A pneumatic cylinder includes a cylinder block, two piston rods, and two pairs of pistons. The cylinder block defines two receiving portions parallel to each other. Each receiving portion defines a first air chamber and a second air chamber; the second air chamber is in series with the first air chamber Each piston rod is partially received in one receiving portion. Each pair of pistons is sleeved on one piston rod, with two pistons received in the first air chamber and the second air chamber, respectively.

8 Claims, 4 Drawing Sheets

PNEUMATIC CYLINDER

BACKGROUND

1. Technical Field

The present disclosure relates to pneumatic cylinders.

2. Description of Related Art

Pneumatic cylinders are often used in Computerized Numerical Control lathes to drive a clamping mechanism to fix a workpiece. A typical pneumatic cylinder includes a cylinder block, a piston rod, and a piston. The pneumatic cylinders are powered by compressed air, and controlled to drive the piston in a desired direction, whereby the piston rod transfers force to an effector, such as a clamping mechanism.

Diameter of the piston and the force exerted by the pneumatic cylinder are related. However, when greater force is needed, the correspondingly increased diameter of the piston which is required can compromise space conservation efforts.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
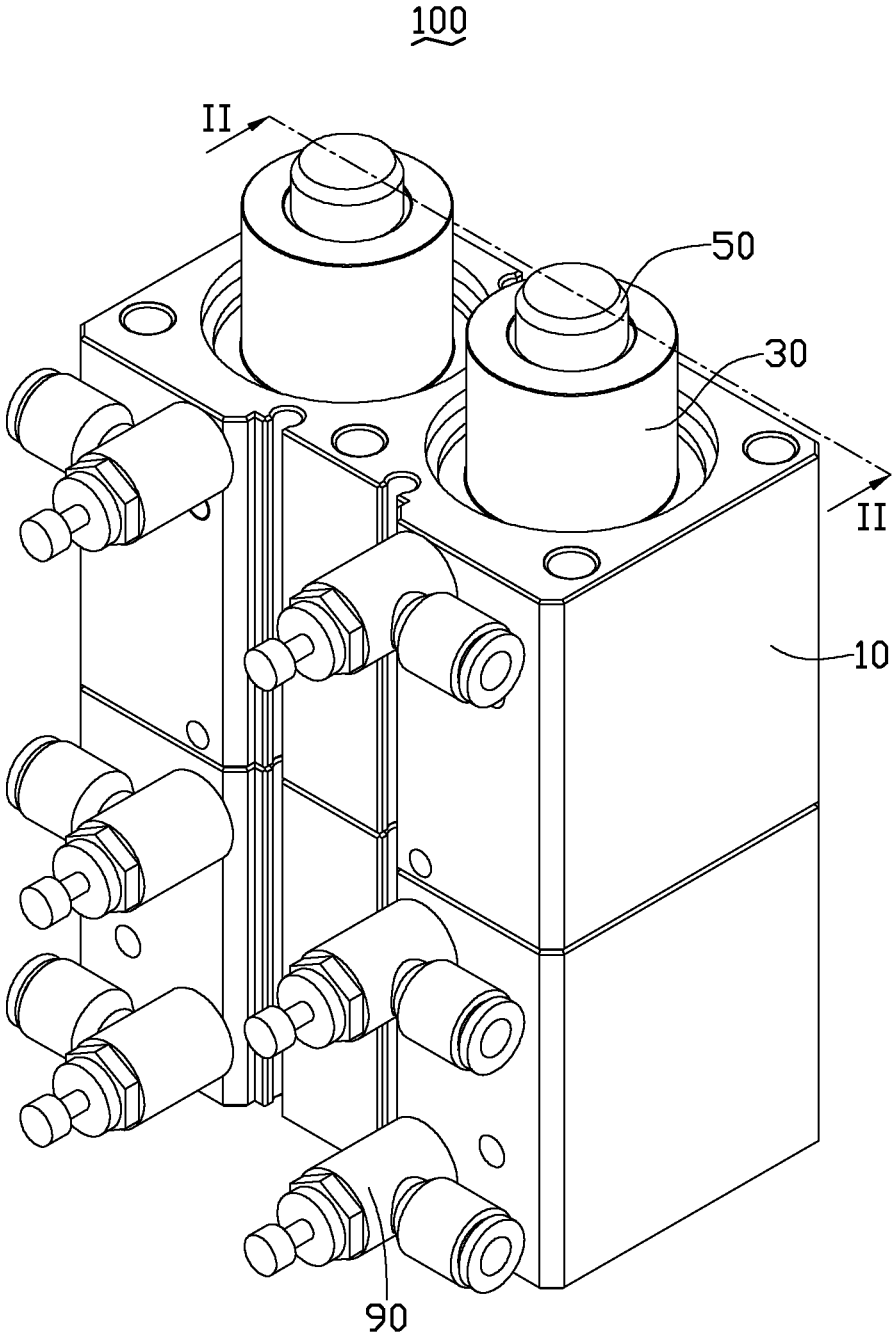
FIG. 1 is an assembled, isometric view of one embodiment of a pneumatic cylinder.
Figure 2:
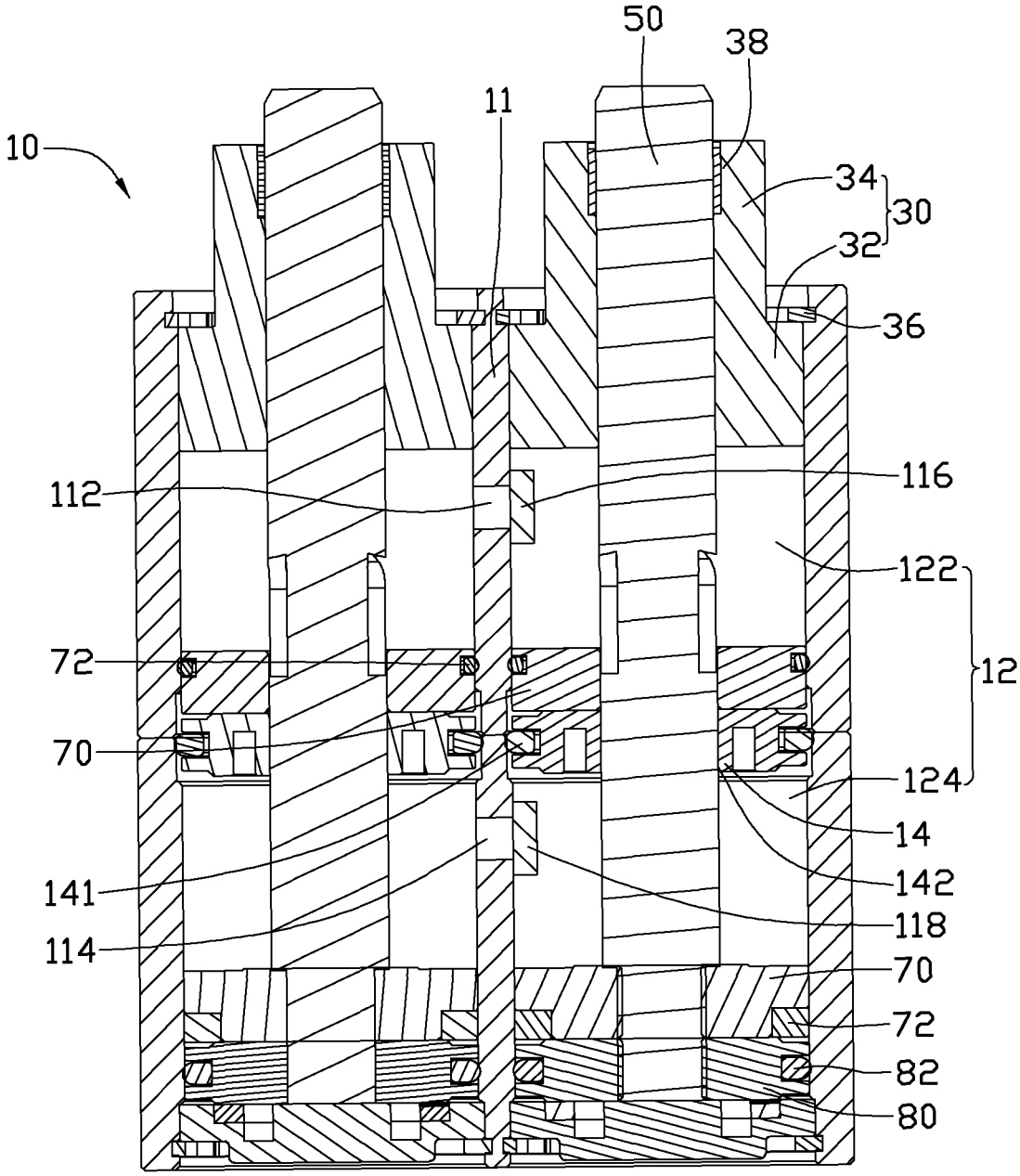
FIG. 2 is a cross section of the pneumatic cylinder taken along line II-II in FIG. 1.

Referring to FIG. 1 and FIG. 2, an embodiment of a pneumatic cylinder 100 includes a cylinder block 10, two covers 30, two piston rods 50, four pistons 70, two induction members 80, and a plurality of air valves 90.

The cylinder block 10 is substantially a hollow rectangular structure, and includes a partition member 11 formed therein. The cylinder block 10 defines two receiving portions 12 separated by the partition member 11. Each receiving portion 12 is substantially a hollow column, with axes thereof parallel to each other. Each receiving portion 12 is divided into a first air chamber 122 and a second air chamber 124 by a division plate 14. The first air chamber 122 and the second air chamber 124 are in series. The division plate 14 extends substantially perpendicular to an axis of the receiving portion 12. A first seal ring 141 is positioned between a side surface of the division plate 14 and an inner side surface of the receiving portion 12. The division plate 14 defines a through hole 142 through which the piston rod 50 passes.

Figure 3:
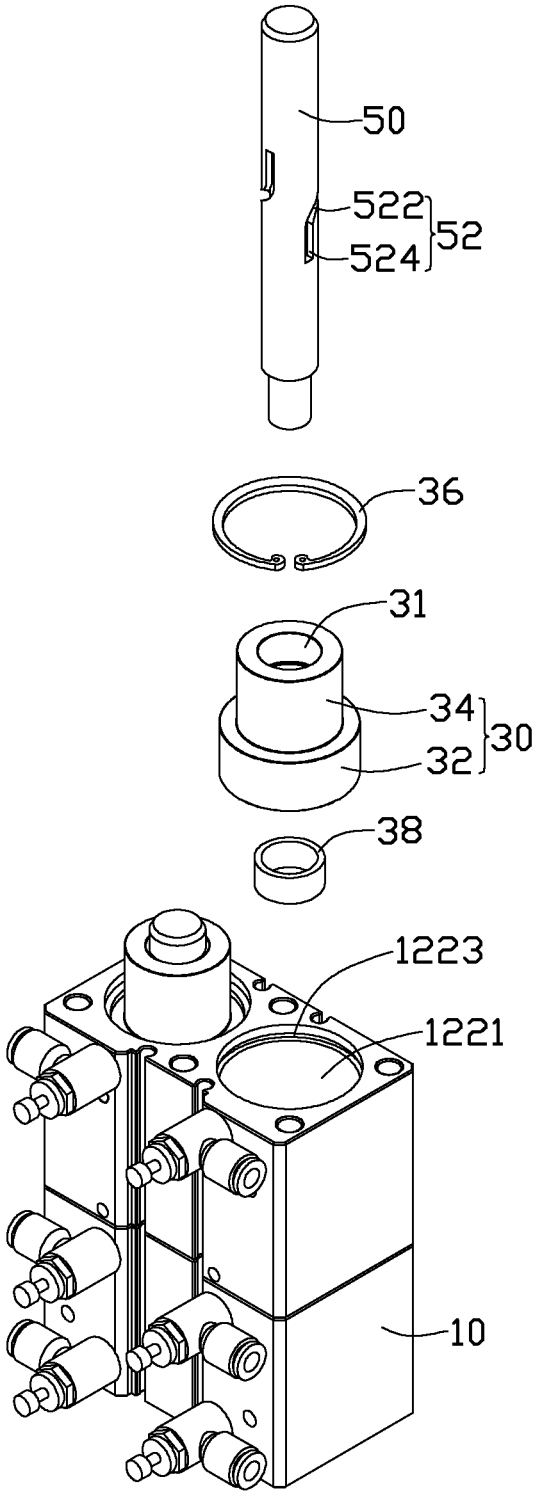
FIG. 3 is an exploded, isometric view of the pneumatic cylinder of FIG. 1.
Figure 4:
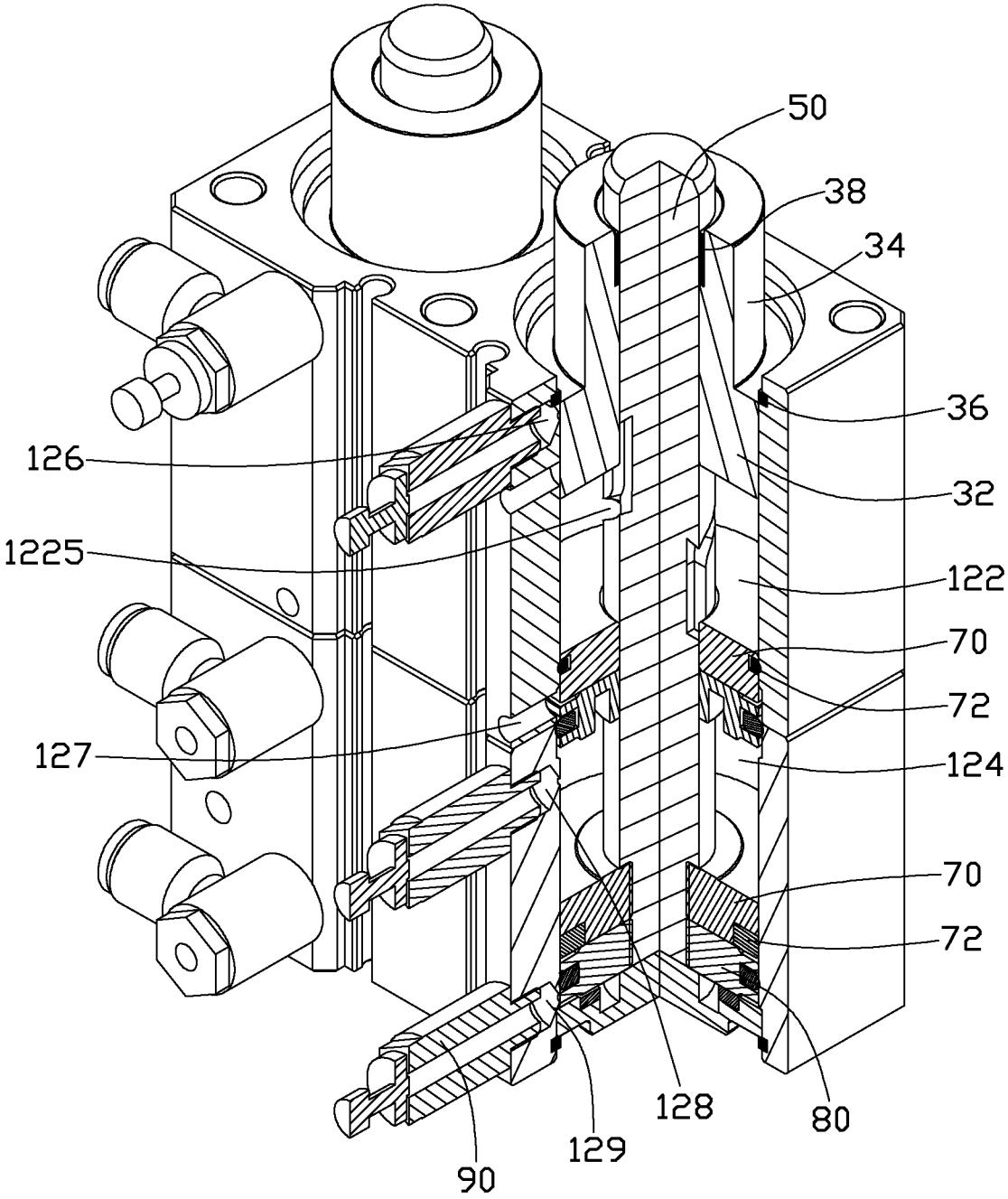
FIG. 4 is a cutaway view of the pneumatic cylinder of FIG. 1.

Referring to FIG. 3 and FIG. 4, each first air chamber 122 defines an opening 1221 at an end away from the second air chamber 124, and a receiving groove 1223. The receiving groove 1223 depresses from an inner side surface of the opening 1221. Each cover 30 covers the corresponding opening 1221. Each first air chamber 122 defines a first air hole 126 adjacent to the cover 30, and a second air hole 127 adjacent to the division plate 14. Each first air chamber 122 further forms a guide protrusion 1225 protruding from an inner side surface of each of the first air chambers 122. Each second air chamber 124 defines a third air hole 128 adjacent to the division plate 14, and a fourth air hole 129 away from the division plate 14. The first air holes 126, the second air holes 127, the third air holes 128 and the fourth holes 129 selectively communicate with an air source (not shown) via the air valves 90.

The cover 30 is substantially cylindrical, and defines a guide hole 31 extending along a first axis of the cover 30. The cover 30 includes a fixing portion 32 and a guide portion 34. A cross-section of the fixing portion 32 corresponds in shape and size to the opening 1221. The fixing portion 32 plugs the opening 1221. The guide portion 34 extends from an end of the fixing portion 32 away from the opening 1221. In the illustrated embodiment, the guide portion 34 has a diameter less than that of the fixing portion 32. Each cover 30 further includes a second seal ring 36 and a third seal ring 38. Each second seal ring 36 is at least partially received in the receiving groove 1223, and resists the fixing portion 32.

The piston rod 50 is substantially cylindrical. Each piston rod 50 defines a guiding groove 52. In the illustrated embodiment, the guiding groove 52 includes a spiral groove 522, and two straight grooves 524. Two straight grooves 524 extend from two opposite ends of the spiral groove 522 along a first axis of the piston rod 50. Two pistons 70 are sleeved on one piston rod 50, and are spaced apart. Each piston rod 50 is partially received in one receiving portion 12, with one end of the piston rod 50 passing through the through hole 142 and the guide hole 31, and then protruding from the cylinder block 10. The third seal ring 38 is sleeved on the piston rod 50 and placed between the piston rod 50 and an inner surface of the guide hole 31. Two pistons 70 sleeved on the piston rod 50 are received in the first air chamber 122 and the second air chamber 124, respectively. The guide protrusion 1225 is slidably received in the guiding groove 52. Each piston 70 includes a seal member 72 positioned between an outer surface of the piston 70 and an inner surface of the receiving portion 12.

The induction members 80 are configured to detect travel of the piston 70. In the illustrated embodiment, the induction members 80 are a plurality of magnetic rings, each induction member 80 is sleeved on an end of one piston rod 50 away from the cover 30, and received in the second air chamber 124. A fourth seal ring 82 is positioned between an outer surface of the induction member 80 and an inner surface of the second air chamber 124. It should be pointed out that the induction members 80 are not limited to being received in the second air chambers 124, and may alternatively be received in the first air chambers 122.

In use, air enters the second air chambers 124 through the fourth air holes 129, and moves the pistons 70 received in the second air chambers 124 toward the division plates 14. Each guide protrusion 1225 slides along one guiding groove 52, until the piston rods 50 transfer the force exerted by the pistons 70 to an object. During retraction, air enters the first air chambers 122 and the second air chambers 124 through the first air holes 126 and the third air holes 128 respectively, and forces the pistons 70 to move back.

The pneumatic cylinder 100 includes two receiving portions 12 parallel to each other, and each receiving portion 12 includes the first air chamber 122 and the second air chamber 124, such that the pneumatic cylinder 100 has a more compact structure, and occupies less space. The pneumatic cylinders 100 have four pistons 70 which convert the potential energy of compressed gas into kinetic energy, thereby maximizing the exerted force of the pneumatic cylinder 100.

The division plates 14 may be omitted, as long as each receiving portion 12 is divided into the first air chamber 122 and the second air chamber 124 by the piston 70 adjacent to the cover 30. The guide protrusions 1225 are not limited to be formed in the first air chambers 122, and may alternatively be formed in the second air chambers 124, as long as the position of the guiding grooves 52 is changed accordingly.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A pneumatic cylinder, comprising:

a cylinder block;

two piston rods; and two pairs of pistons, wherein the cylinder block defines two receiving portions parallel to each other, each receiving portion defines a first air chamber and a second air chamber, the second air chamber is in series with the first air chamber, each piston rod is partially received in one receiving portion, and each pair of pistons is sleeved on one piston rod with two pistons received in the first air chamber and the second air chamber, respectively; the cylinder block further comprises a partition member and two division plates, the partition member divides the cylinder block into the two receiving portions, and each division plate divides each of the receiving portions into the first air chamber and the second air chamber.

2. The pneumatic cylinder of claim 1, wherein each piston rod defines a guiding groove, each receiving portion forms a guide protrusion protruding from an inner surface of the receiving portion, and the guide protrusion is slidably received in the guiding groove.

3. The pneumatic cylinder of claim 2, wherein the guiding groove comprises a spiral groove and two straight grooves extending from two opposite ends of the spiral groove.

4. The pneumatic cylinder of claim 1, wherein each division plate defines a through hole for the piston rod passing through.

5. The pneumatic cylinder of claim 1, further comprising two covers, wherein each first air chamber defines an opening at an end away from the second air chamber, each cover defines a guide hole, and covers one opening with the piston rod passing through the guide hole.

6. The pneumatic cylinder of claim 1, further comprising at least one induction member, wherein the at least one induction member is sleeved on one piston rod to detect travels of the piston.

7. The pneumatic cylinder of claim 1, wherein each first air chamber defines a first air hole and a second air hole, and each second air chamber defines a third air hole and a fourth air hole.

8. A pneumatic cylinder, comprising:

a cylinder block;

two piston rods;

two pairs of pistons, wherein the cylinder block defines two receiving portions parallel to each other, each receiving portion defines a first air chamber and a second air chamber, the second air chamber is in series with the first air chamber, each piston rod is partially received in one receiving portion, and each pair of pistons is sleeved on one piston rod with two pistons received in the first air chamber and the second air chamber, respectively; and two covers, wherein each first air chamber defines an opening at an end away from the second air chamber, each cover defines a guide hole, and covers one opening with the piston rod passing through the guide hole, wherein each opening defines a receiving groove depressed from an inner side surface of the opening, each cover comprises a fixing portion plugging the opening, a guide portion, and a seal ring, the seal ring is partially received in the receiving groove and resists the fixing portion of the cover.

* * * * *